US008894190B2

(12) United States Patent
Walkington et al.

(10) Patent No.: US 8,894,190 B2
(45) Date of Patent: Nov. 25, 2014

(54) RELATING TO INKJET PRINTERS

(75) Inventors: Stuart Mark Walkington, St. Albans (GB); Brian Patrick Guinee, St. Neots (GB)

(73) Assignee: Domino Printing Sciences PLC (GB)

( * ) Notice: Subject to any disclaimer, the term of this patent is extended or adjusted under 35 U.S.C. 154(b) by 0 days.

(21) Appl. No.: 13/885,211

(22) PCT Filed: Nov. 21, 2011

(86) PCT No.: PCT/GB2011/052273

§ 371 (c)(1), (2), (4) Date: Jul. 12, 2013

(87) PCT Pub. No.: WO2012/066354

PCT Pub. Date: May 24, 2012

(65) Prior Publication Data

US 2013/0278686 A1 Oct. 24, 2013

(30) Foreign Application Priority Data

Nov. 19, 2010 (GB) ..... 1019685.5
Nov. 19, 2010 (GB) ..... 1019688.9

(51) Int. Cl.
*B41J 2/175* (2006.01)

(52) U.S. Cl.
CPC ..... *B41J 2/17503* (2013.01); *B41J 2/17523* (2013.01); *B41J 2/175* (2013.01); *B41J 2/1752* (2013.01)
USPC ..... 347/86; 347/89

(58) Field of Classification Search
USPC ..... 347/7, 49, 85, 86, 89
See application file for complete search history.

(56) References Cited

U.S. PATENT DOCUMENTS

| | | | | |
|---|---|---|---|---|
| 6,065,829 | A * | 5/2000 | Ruiz et al. | 347/85 |
| 6,863,388 | B2 * | 3/2005 | Seino et al. | 347/86 |
| 7,677,710 | B2 * | 3/2010 | Kobayashi et al. | 347/85 |
| 2002/0024571 | A1 | 2/2002 | Childers et al. | |
| 2004/0100539 | A1 | 5/2004 | Ujita | |
| 2006/0203045 | A1 | 9/2006 | Kobayashi | |

FOREIGN PATENT DOCUMENTS

| | | |
|---|---|---|
| EP | 2080620 | 7/2009 |
| WO | 2009049146 | 4/2009 |
| WO | 2009089567 | 7/2009 |

* cited by examiner

*Primary Examiner* — Anh T. N. Vo
(74) *Attorney, Agent, or Firm* — Price Heneveld LLP

(57) ABSTRACT

The invention describes a continuous inkjet printer having an ink distribution block and an ink module containing ink and filters which can be connected to the distribution block with a substantially horizontal linear sliding action. Spigots forming part of the connection are preferably provided with upward facing fluid transfer ports.

3 Claims, 3 Drawing Sheets

RELATING TO INKJET PRINTERS

FIELD OF THE INVENTION

This invention relates to inkjet printers and, more particularly, to a means of connecting an ink service module to an ink system of a continuous inkjet printer.

BACKGROUND

Ink is typically supplied to a continuous inkjet printer from a disposable ink bottle. The ink bottle may be mounted on an ink reservoir that includes mating connection which allows ink to pass from the ink bottle into the ink reservoir. Each ink bottle contains a finite amount of ink, typically a pint or liter of ink. As the ink jet printing system is used, the ink within the ink bottle is drained. When the ink bottle is fully depleted, the depleted ink bottle is replaced by a new, full bottle. Hence the level of ink in the reservoir is maintained at a particular level.

The properties of the printing ink may deteriorate over time. How long this may take depends upon a number of factors such as the rate at which new ink and/or make-up is added, the environment in which the printer is operating and the ingredients from which the ink is made.

All manufacturers of continuous inkjet printers provide filtration within the ink system to limit the size of, and trap, particulate matter that may form in the ink. Such filters require replacement at a regular service interval. It is also typical to replace the bulk of the ink in the printer with fresh ink at the same time as the filters are replaced. Usually this service action is undertaken by skilled personnel, e.g a service technician or maintenance staff, and requires the printer to be taken out of service and off line for approximately 30 to 60 minutes.

In a continuous inkjet print currently manufactured by the applicant, the ink reservoir is an open-topped vessel on to which a manifold is fitted. The manifold is hydraulically connected to an ink management (distribution) block by flexible tubing. The manifold has an ink pick up tube and level sensing electronics that are immersed in the ink. The ink system filter(s) are also connected by flexible tubing. When changing the reservoir and the filters a number of individual lines must be disconnected and, in turn, re-connected. Accordingly there is potential for ink spillage and for the service technician to be exposed to solvent fumes. There is also potential for the replacement filter(s) to be fitted incorrectly.

It is an object of the invention to provide a continuous inkjet printer which will go at least some way in addressing the aforementioned problems; or which will at least offer a novel and useful alternative.

SUMMARY OF THE INVENTION

Accordingly the invention provides a continuous inkjet printer having an ink distribution system and an ink module containing ink and one or more filters, said ink module being engageable with said ink distribution system, said printer being characterized in that the connections between said ink distribution system and said ink module comprises a plurality of substantially horizontally aligned, inter-engaging, sockets and spigots provided on facing surfaces of said ink distribution system and said ink module which are arranged to allow said ink module to be engaged with said ink distribution system by way of a linear, substantially horizontal, displacement.

Preferably said spigots project from said ink module and said sockets are included in said ink distribution system.

Preferably each of said spigots has an upwardly facing fluid transfer port.

Preferably said printer further includes a make-up fluid module engageable with said ink distribution system, said make-up fluid module having one or more spigots thereon constructed and arranged to engage in corresponding sockets in said ink distribution system wherein the arrangement of spigots on said make-up fluid module differs from the arrangement of spigots on said ink module.

Many variations in the way the present invention can be performed will present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future.

BRIEF DESCRIPTION OF THE DRAWINGS

One embodiment of the invention will now be described with reference to the accompanying drawings in which.

DESCRIPTION OF WORKING EMBODIMENT

This invention provides a continuous inkjet printer having an ink distribution system 10 and an ink module 11 containing ink and one or more filters. As with known continuous inkjet printers the ink module 11 is, in use, engaged with the ink distribution system or block 10 to transfer ink into the ink distribution system and to filter ink circulated back into the module from the ink system. The characteristic feature of the invention is that the connection between the ink distribution block and the ink module is provided in the form of a plurality of horizontally aligned, inter-engaging, sockets and spigots provided on facing surfaces of the ink distribution block and the ink module. This arrangement allows the ink module to be directly engaged with the ink distribution block by way of a simple horizontal displacement. No intervening tubes or other connections are required. In this way, fresh volumes of ink and new filters can be easily and cleanly installed, in one simple action, by persons having no specialist skills.

Figure 3:
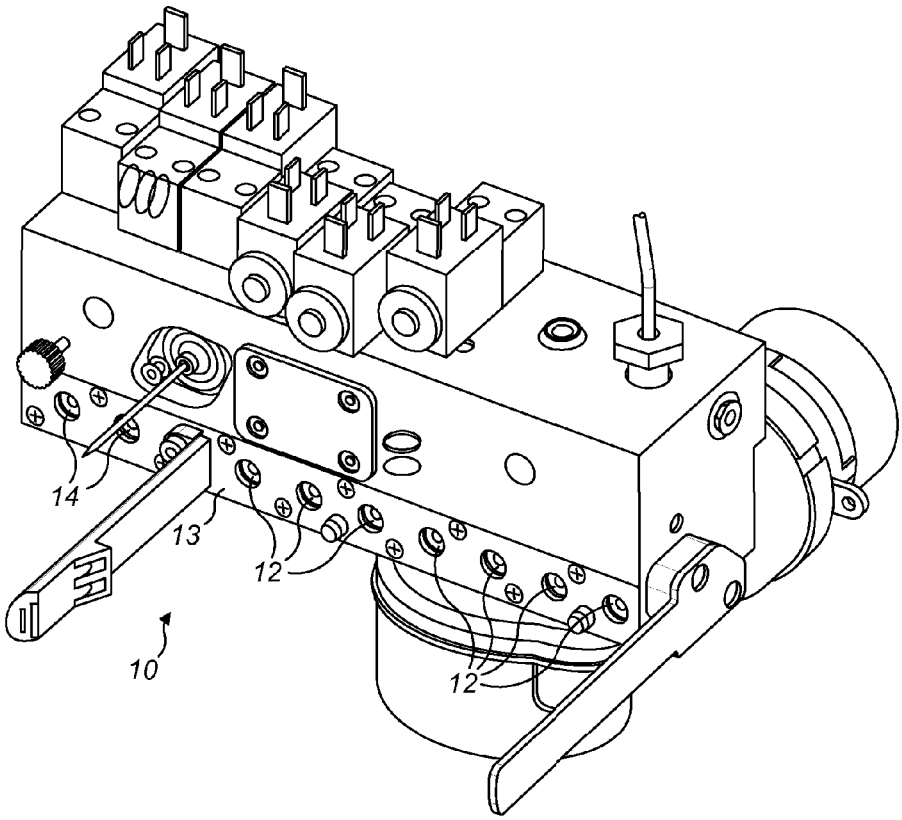
FIG. 3: shows an isometric view of one side of an ink distribution facility incorporated in a printer according to the invention.

As can be seen in FIG. 3, the ink distribution system 10 includes a plurality of substantially valves or sockets 12 located in a row along that surface 13 of the ink distribution system which faces towards the front of the printer. As can be seen, the valves or sockets 12 are aligned horizontally and comprise a set of seven. A further set of two sockets, defined by valves or sockets 14, are provided for exchanging fluid with a make-up module 15.

Figure 1:
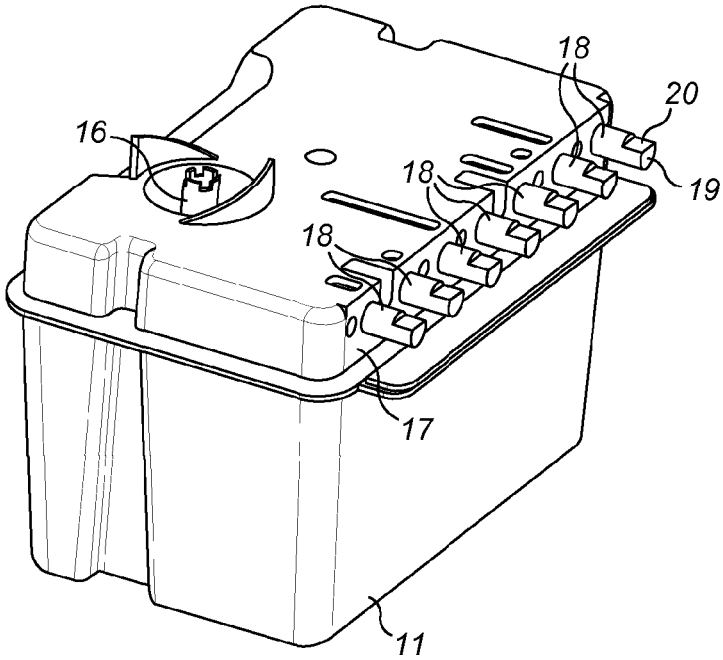
FIG. 1: an isometric view of an ink module for use in a printer according to the invention.
Figure 2:
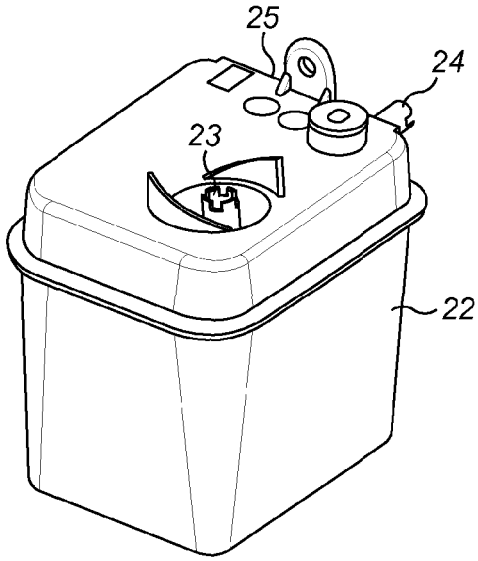
FIG. 2: shows an isometric view of a make-up module for use in a printer according to the invention.
Figure 4:
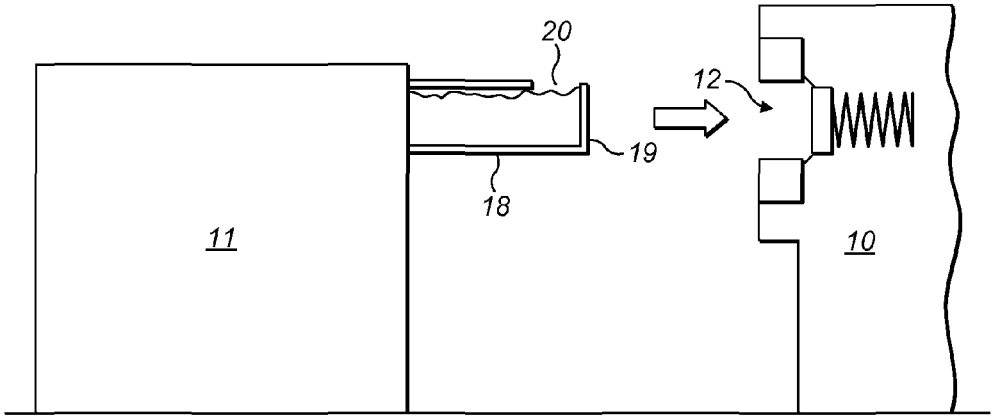
FIG. 4: shows a schematic elevation of the engagement between a module and an ink distribution facility of a printer according to the invention.
Figure 5:
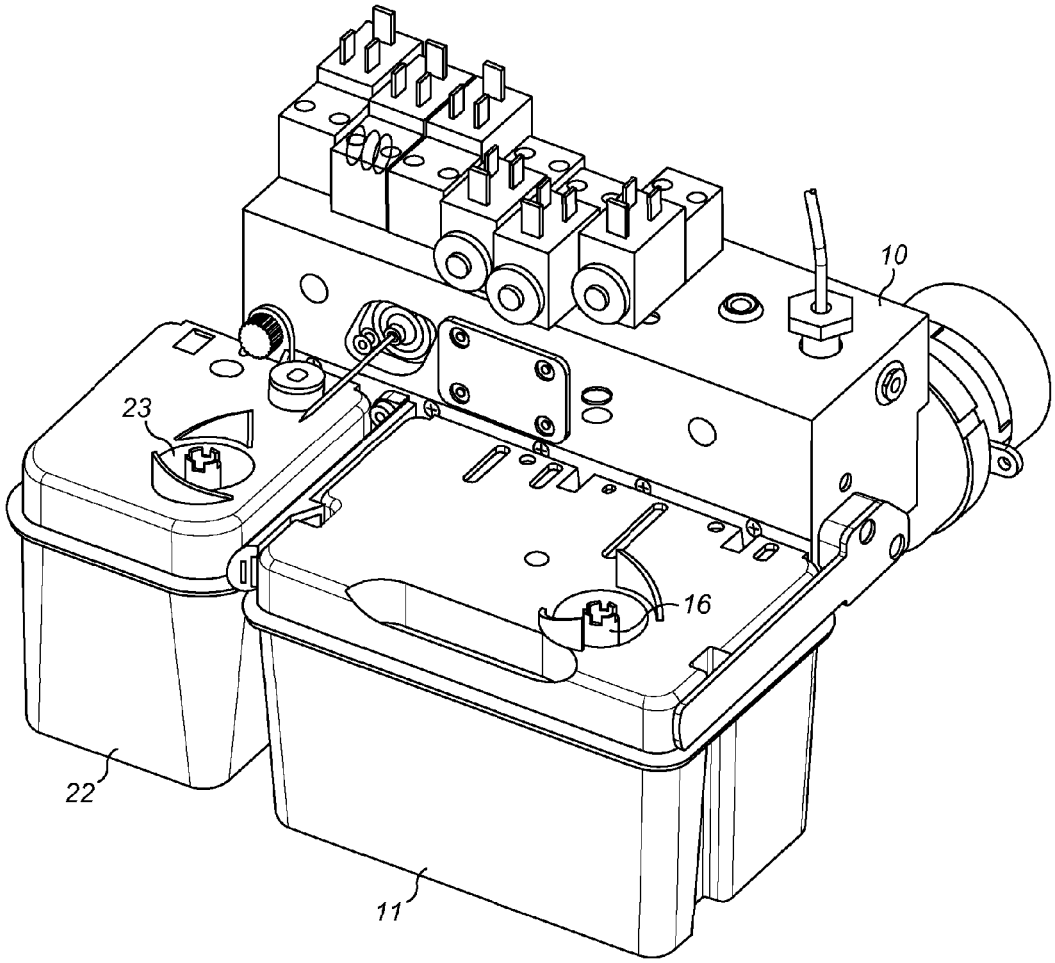
FIG. 5: shows an isometric view of the ink module shown in FIG. 1 and the make-up module shown in FIG. 2 assembled on to the ink distribution facility shown in FIG. 3.

Referring to FIG. 1, it can be seen that the ink module 11 has a connection 16 for mounting a disposable ink bottle (not shown) and, on an upper outer surface 17 thereof, a plurality of spigots 18. As shown, seven spigots 18 are provided in a horizontal row. The spigots 18 are also horizontally aligned and are sized and positioned to engage the sockets 12 on the ink distribution block. It will thus be appreciated that the ink module can be engaged and inserted/extracted by sliding the service module into and out of the printer in a horizontal movement as indicated by the arrow in FIG. 4. This means that the space required to fit, remove and retain the ink module is minimised.

A further feature of the invention is that ink is withdrawn from the module 11 into the ink distribution system 10 along an axis substantially perpendicular to the axis along which the module is engaged with the ink distribution system. To this end it will also be noted from FIGS. 1 & 4 that the distal end 19 of each of the spigots 18 is closed and a top-side opening or port 20 is provided adjacent to the end 19. Thus ink passing from the module 11 into the distribution system 10 must pass vertically through the port 20. The top-side port 20 has a dual function of allowing the non drip valve within the ink distribution block 10 to open and maintain a fluid flow path, whilst reducing the likelihood of fluid dripping from the spigot 18 when the ink module 12 is extracted.

In a similar manner to the ink module, the make-up service module 22 includes a connection 23 for a disposable make-up bottle (not shown) and two spigots, one of which is shown at 24, projecting horizontally from an upper side 25 thereof. The spigots 24 are positioned, sized and aligned to engage in the sockets 14 in the ink circulation block 10 and thus the make-up fluid module 22 can be engaged with the ink circulation block 10 with the same horizontal linear sliding action. It will be seen, however, that the geometry of the connections on the make-up fluid module differs from that of the connections on the ink module. As a consequence, the ink module cannot be connected into the make-up fluid sockets, and vice versa but the space requirement for the make-up module is also minimised because of the horizontal engagement feature.

It will thus be appreciated that the invention allows the filters and ink to be changed without the use of tools by lower skilled operators. Further, printer downtime is reduced significantly in that the printer is shut down under the normal shut down controls: the service module is unclipped and removed; a new service module is fitted, primed with new ink, and the printer is restarted under normal start up controls. The procedure can be completed in less than about 5 minutes and the operator has minimal exposure to ink and solvent fumes. Still further, the module can only be fitted in one way and therefore the opportunity to fit incorrectly or to fit the filters the wrong way round or to the wrong connection is eliminated.

Thus the invention, at least in the case of the working embodiment described, provides a neat and effective arrangement for mounting the ink and make-up fluid modules. At least in the case of the embodiment described, tube connections and other manually connectable plumbing connections between the service module and ink system are eliminated. This enables replacement of the modules without the need for specialist skill and knowledge whilst minimizing the risk of spillage.

The invention claimed is:

1. A continuous inkjet printer comprising:

an ink circulation system;

an ink module containing ink and one or more filters, said ink module being engageable with said ink circulation system; and a make-up fluid module engageable with said ink circulation system, wherein the connection between said ink circulation system and said ink module comprises a plurality of substantially horizontally aligned, inter-engaging, sockets and spigots provided on facing surfaces of said ink circulation system and said ink module which are arranged to allow said ink module to be engaged with said ink circulation system by way of a linear, substantially horizontal, displacement, and wherein said make-up fluid module having one or more spigots thereon constructed and arranged to engage in corresponding sockets in said ink circulation system wherein the arrangement of spigots on said make-up fluid module differs from the arrangement of spigots on said ink module.

2. A continuous inkjet printer as claimed in claim 1 wherein said spigots project from said ink module and said sockets are included in said ink circulation system.

3. A continuous inkjet printer as claimed in claim 1 wherein each of said spigots includes an upwardly facing fluid transfer port.

* * * * *